US005779468A

United States Patent [19]

Helker

[11] Patent Number: 5,779,468

[45] Date of Patent: Jul. 14, 1998

[54] DEVICE FOR SUPPLYING GAS TO ROTARY KILNS

[75] Inventor: Heinrich Helker, Krefeld, Germany

[73] Assignee: Bayer Aktiengesellschaft, Leverkusen, Germany

[21] Appl. No.: 628,176

[22] Filed: Apr. 4, 1996

[30] Foreign Application Priority Data

Apr. 11, 1995 [DE] Germany ..... 195 13 203.3

[51] Int. Cl.[6] ..... F27B 7/06; F27B 7/10

[52] U.S. Cl. ..... 432/103; 432/113

[58] Field of Search ..... 432/103, 105, 432/113, 14

[56] References Cited

U.S. PATENT DOCUMENTS 4,373,909 2/1983 Petit et al. ..... 432/113

5,431,560 7/1995 Helker et al. .

FOREIGN PATENT DOCUMENTS 4334795 4/1995 Germany .

1 145 224 3/1985 U.S.S.R. .

1145224 3/1985 U.S.S.R. ..... 432/113

OTHER PUBLICATIONS

Derwent Abstract, A.N. 35–247,885, abstract of SU 1,145, 224 (1985).

*Primary Examiner*—Henry A. Bennett
*Assistant Examiner*—Gregory Wilson
*Attorney, Agent, or Firm*—Sprung Kramer Schaefer & Briscoe

[57] ABSTRACT

The invention relates to a device for supplying gas to a rotary kiln, which has a gas supply pipe 5 divided into segments 17 which is connected to an external gas source via an enclosing bracket 7.

3 Claims, 3 Drawing Sheets

Section C-D

DEVICE FOR SUPPLYING GAS TO ROTARY KILNS

BACKGROUND OF THE INVENTION

1. Field of the Invention

The present invention relates to an improved device for supplying gas to a rotary kiln, and in particular to the material to be calcined which is arranged inside the rotary kiln, in which the gas is supplied through the shell of the rotary kiln. In industry rotary kilns are used, inter alia, for carrying out solid/gas reactions at high temperatures, such as for example for the oxidising decomposition of ores. For this purpose the ground ore is heated to the decomposition temperature in the rotary kiln and contacted at this temperature with oxygen-containing gases inside the kiln. The required residence time frequently depends on the intensity of the contact between the oxygen-containing gas and the material to be calcined, both the oxygen concentration in the rotary kiln atmosphere and the ability of the oxygen to penetrate the bed of material in the rotary kiln playing an important role. In particular where rotary kilns are heated directly by hot flame gases it is almost impossible to maintain oxygen contents exceeding approximately 10% in the kiln atmosphere. It is therefore desirable to inject the oxygen or other gases required for the reaction in the rotary kiln directly through the shell of the rotary kiln into the bed of material to be calcined. This does however involve the problem of supplying gases from a stationary source to the injection nozzles which rotate about the axis of the rotary kiln together with the shell.

2. Description of Related Art

Parallel German Patent Application/Serial No. P 43 34 795.9 describes a gas supply device which allows a rotary kiln to be supplied with gas via a sliding annular channel by means of a disc connected to the rotary kiln. The disc has an annular channel containing holes or gas inlets into the interior of the rotary kiln and engages into a static, concentric groove which surrounds the disc. The groove is connected to the external gas source and forms a gas supply chamber with the annular channel of the disc, which chamber is sealed with concentric sealing elements.

In such an arrangement considerable frictional forces arise as a result of the circumferential sealing rings. In addition it is not possible to control the supply of gas to the interior of the kiln specifically in the region of the material to be calcined.

SUMMARY OF THE INVENTION

The abovementioned problems are solved by means of a device for supplying gas to a rotary kiln, which device is the subject matter of the present invention, comprises gas supply nozzles which penetrate the shell of the rotary kiln and are supplied by essentially stationary gas supply lines and is characterised by a gas supply pipe which has two preferably parallel lateral surfaces and concentrically surrounds the shell of the kiln and which is divided by interior intermediate walls into preferably at least 6 segments of a circle which are individually connected to the nozzles of the kiln by at least one gas supply line, and is also characterised in that the gas supply pipe engages into a stationary bracket having an external gas supply means, in that the bracket forms a gas supply chamber with one lateral surface of the pipe, which chamber is sealed by an endless sliding sealing element, at least 2 openings containing inlet valves being present per segment in at least one lateral surface, and in that at least one inlet opening is always enclosed in the gas supply chamber and a sliding surface rests in the form of a counter-support against the other side of the pipe.

One problem with the use of a sliding annular channel for the supply of gas is that this generally does not allow sufficient clearance between the moving and stationary parts. Large industrial rotary kilns of a length of for example 30 to 50 m and a diameter of 3 to 5 m display considerable fluctuations of from a few millimeters up to centimeters from the strictly rotationally symmetrical movement of one circumferential line. The device according to the invention allows not only relative movements of the gas supply pipe in relation to the bracket in the radial direction, i.e. perpendicularly to the axis of the rotary kiln—the sealing means on the flat lateral surfaces of the gas supply pipe sliding in a radial direction—but also a certain degree of play of the gas supply means in an axial direction, especially when the bracket is suspended in a floating manner. The advantage of the device according to the invention is that the contact surface between the sliding seal and the lateral surface of the gas supply pipe is relatively small. Since no sealing means encircling the shell of the kiln are required, there are no sealing problems due to manufacturing tolerances or distortions of, for example, the lateral surface of the gas supply tube. The sealing components of the device are less subject to wear and the device is operationally reliable.

Due to the separation into segments, in particular at least 6 segments, the gas supply can be restricted to very specifically selected regions of the kiln interior, such as for example merely to the gas chamber or merely to that section of the kiln covered with material to be calcined. Only one pipe segment is supplied with gas at a time, of which at least one opening is arranged within the gas supply chamber.

All the other segments remain under the internal pressure.

Since the bracket only rests on one section of the gas supply pipe it can be removed for cleaning and servicing purposes even during the operation of the kiln.

The bracket is preferably attached in such a manner that it is reliably prevented from rotating simultaneously with the gas supply pipe while nevertheless yielding to any axial movements, swaying or even knocking of the gas supply tube.

The material normally used for the sliding sealing elements is polytetrafluoroethylene, which is optionally reinforced with glass fibres, and/or graphite, such as for example in the form of a filament.

Normal metal tubes can be used for supplying gas to the bracket.

In a preferred variation the bracket is designed in such a manner that at least two of the openings of the gas supply pipe are always arranged inside the gas supply chamber. Especially those areas of the sliding seal traversed by the openings in the gas supply chamber are at least of the same width as said openings, in order to avoid any escape of gas into the surrounding area. The gas supply pipe and the gas supply lines can be connected via distribution pipes of the commonly known kind.

Additional preferred embodiments are described in the subclaims.

The invention is illustrated in more detail in the following, with the aid of the attached drawings:

BRIEF DESCRIPTION OF THE DRAWINGS

Unless otherwise mentioned, identical numbers denote identical elements in the figures.

The shell 1 of the rotary kiln typically consists of a lining 2 and a cladding 3. The bed of material 4 to be calcined is arranged inside the rotary kiln. The gas inlet pipe 5 with a rectangular cross-section is firmly attached to the shell 1 of the rotary kiln via branches 6. The bracket 7 surrounds the gas supply pipe on three sides. The bracket 7 has a groove 8 on the inside of its left shank for receiving an annular sealing means 9. The sealing means 9 forms a sliding seal with the flat lateral surface 13 of the pipe 5. The downward pressure of the sealing means 9 on the lateral surface 13 is optionally adjustable by means of springs 10 and adjusting screws 11. The gas supply chamber 12 formed between the lateral surface 13, the bracket 7 and the sealing means 9 is supplied by at least one gas supply line 15. If the gas supply chamber 12 is charged with gas of a higher pressure, the check valves 16 in the openings 20, 20' open in the direction of the interior of pipe 5. Pipe 5 is divided into segments 17 by walls 27. Gas inlet nozzles 22 are provided along at least one circumferential line parallel to the gas supply pipe 5. The nozzles 22 are connected to individual segments 17 of the pipe 5 via pipelines 18 and 19. On applying pressure the gas flows from the gas-supplied segment 17 via lines 18, 19 and nozzles 22 into the interior of the kiln, and in particular in the region of the material 4 to be calcined. In FIG. 3 a second injection nozzle 22' is illustrated which belongs to a series of nozzles which are arranged along a second circumferential line on the shell of the rotary kiln. By extending lines 18 and 19 by means of appropriate branches it is possible to supply additional nozzles 22, 22' arranged on a plurality of circumferential lines on the shell of the rotary kiln. Pipes 18 and 19 in particular have flanges 23, 24, 23', 24' which can be opened for the purpose of removing possible blockages. Instead of flanges 24 and 24', a mechanism can advantageously be provided which regularly frees the pipe 18, 19 and the nozzle 22 from any material to be calcined which has infiltrated therein, such as for example whenever the shell of the rotary kiln is not covered with material 4 to be calcined.

Figure 1:
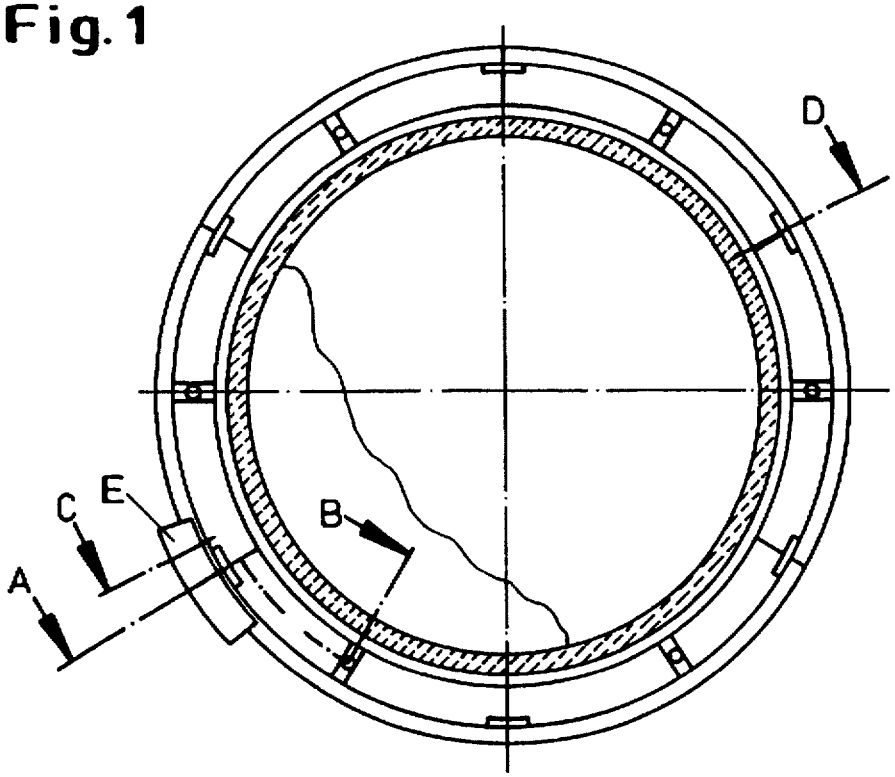
FIG. 1 is a cross-section through the rotary kiln perpendicularly to the axis of the rotary kiln.
Figure 2:
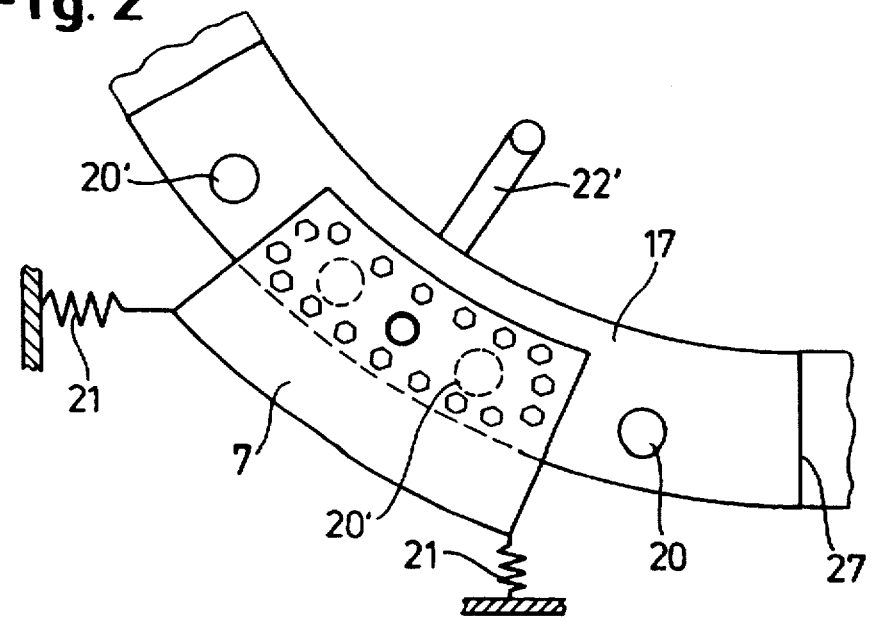
FIG. 2 is an enlarged section of the device according to the invention comprising part of the gas supply pipe and the bracket.
Figure 3:
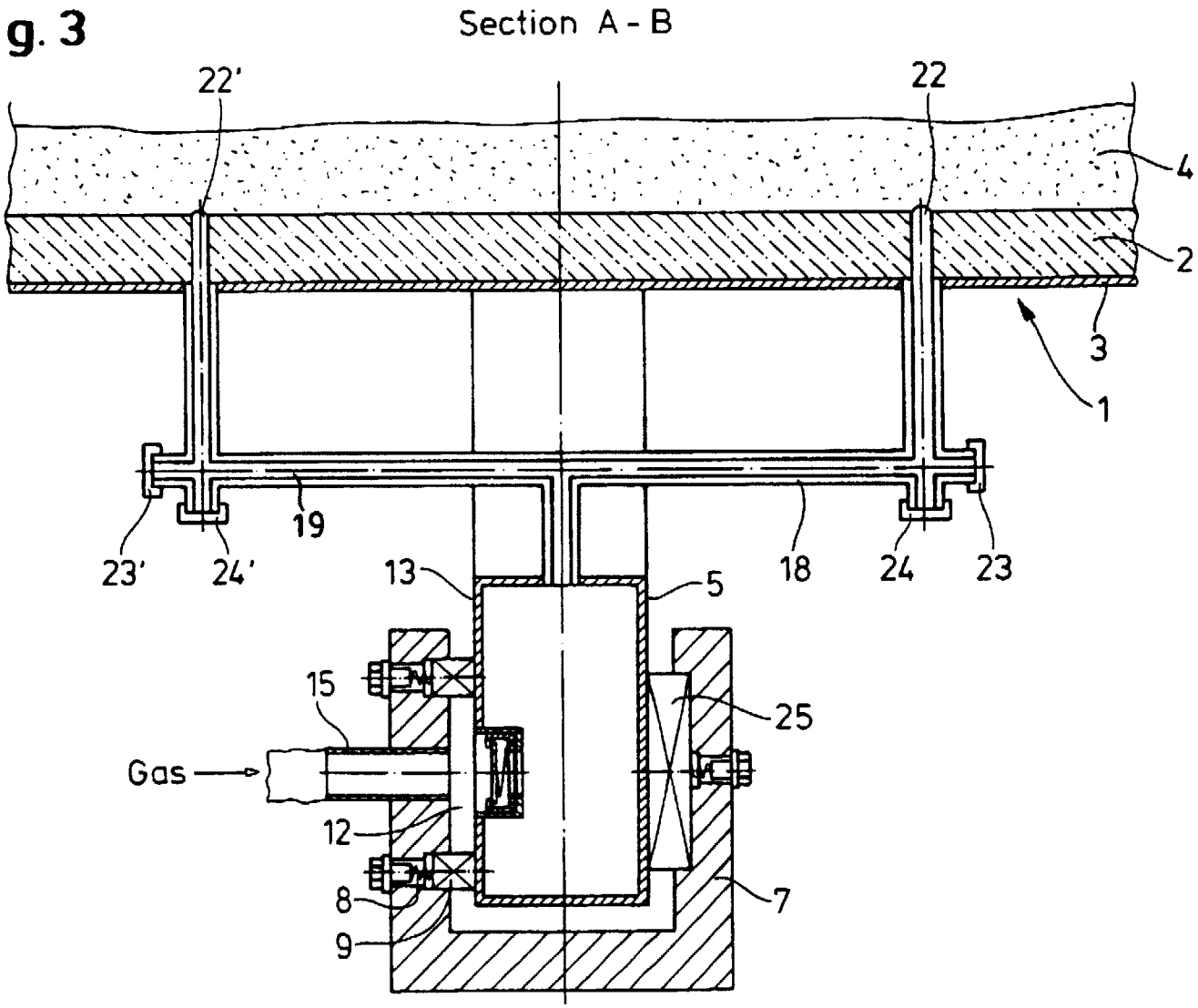
FIG. 3 is an enlarged section (corresponding to A-B in FIG. 1) through a plane comprising the axis of the rotary kiln.
Figure 4:
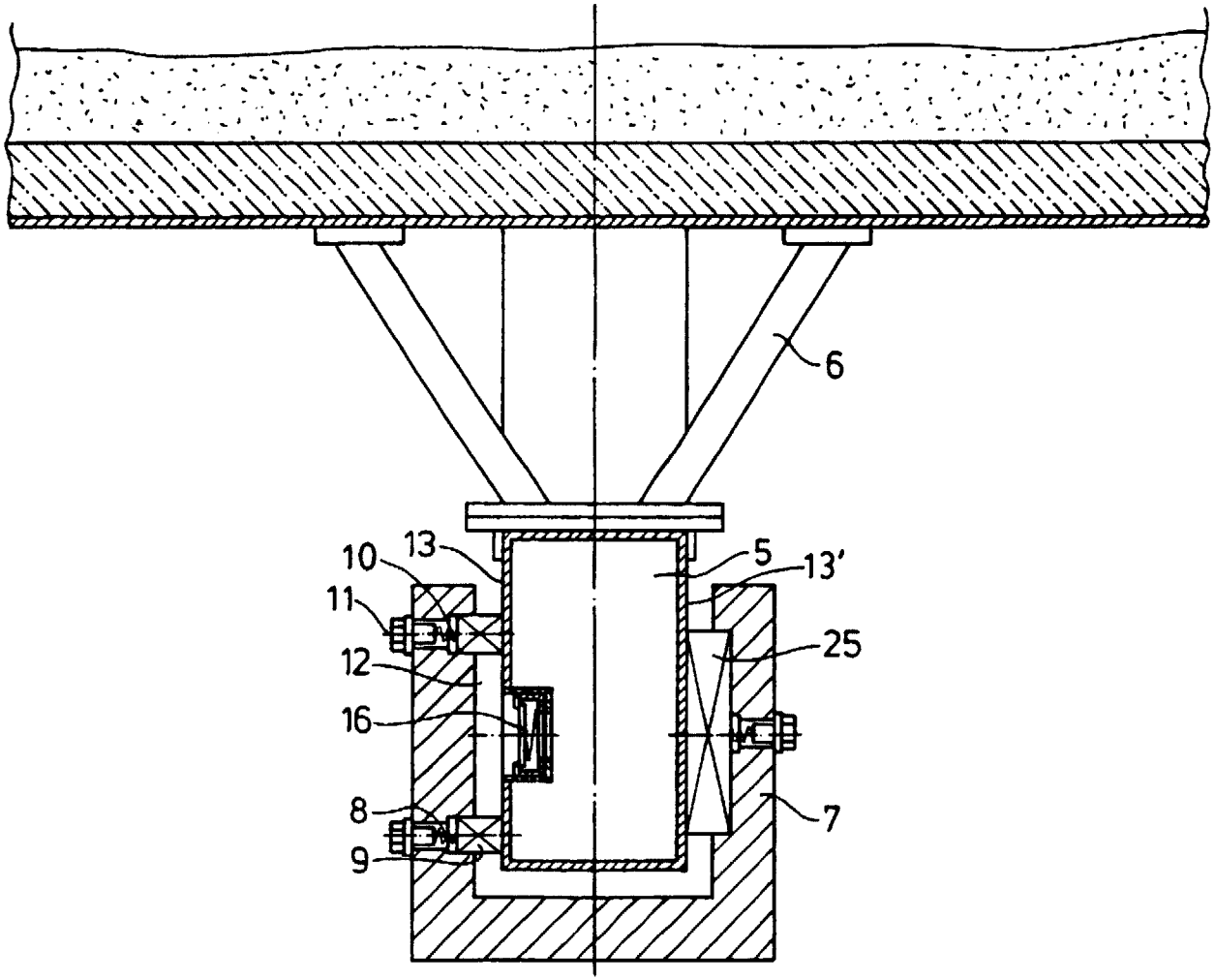
FIG. 4 is an enlarged section (corresponding to C-D in FIG. 1).

In one variation (see FIG. 2) the bracket 7 is positioned on springs 21 in order to allow for possible lateral movements due to imbalances in the gas supply pipe 5 as the kiln rotates. On the second shank of the bracket a sliding surface, which is made of a suitable metallic (e.g. cast iron) or non-metallic material (such as for example PTFE) and corresponds to the size of the sealing means, forms a counter-support 25 (see FIG. 4)

I claim:

1. A device for supplying gas to a rotary kiln comprising gas supply nozzles (22) which penetrate the shell of the rotary kiln and are supplied via essentially stationary gas supply lines (18, 19), which is characterised in that a gas supply pipe (5) having two preferably parallel lateral surfaces (13, 13') is provided which concentrically surrounds the shell of the kiln and is divided by means of interior intermediate walls (27) into segments (17), preferably at least 6 segments (17), which are individually connected to at least one gas supply line (18/19) leading to the nozzles (22) of the kiln, in that the gas supply pipe (5) engages into a stationary bracket (7) having an external gas supply means (15), in that the bracket forms a gas supply chamber (12) with one of the lateral surfaces (13) of the pipe (5), which chamber is sealed off from its surroundings by an endless sliding sealing element (9), at least two openings containing inlet valves (16) being present per segment in at least one lateral surface (13), in that at least one inlet opening (20 or 20') is always enclosed by the gas supply chamber (12) and in that a counter-support (25) in the form of a sliding surface rests against the other side of the pipe (5).

2. Device according to claim 1, characterised in that the bracket (7) is mounted by means of springs in order to allow for any vibrations or imbalances in the pipe (5).

3. Device according to claim 1, characterised in that at least two openings (20 or 20') are always under gas pressure in the region of gas chamber (12) in each position of the gas pipe (5).

* * * * *

UNITED STATES PATENT AND TRADEMARK OFFICE

CERTIFICATE OF CORRECTION

PATENT NO. : 5,779,468

DATED : June 14, 1998

INVENTOR(S) : Helker

It is certified that error appears in the above-identified patent and that said Letters Patent is hereby corrected as shown below:

On the title page item [56], Other Publications

Delete "A.N. 35-247,885" and substitute
--A.N. 85-247-885--

Title Page, [56], Foreign Patent Documents After "Germany" delete "1 145,224 3/1985 U.S.S.R."

Signed and Sealed this

Fourteenth Day of September, 1999

*Attest:*

Q. TODD DICKINSON

*Attesting Officer*

*Acting Commissioner of Patents and Trademarks*